US008631984B2

(12) United States Patent
Carlsson

(10) Patent No.: US 8,631,984 B2
(45) Date of Patent: Jan. 21, 2014

(54) HARNESS AND CHEST PLATE THEREIN

(75) Inventor: Daniel Carlsson, Jönköping (SE)

(73) Assignee: Husqvarna AB, Huskvarna (SE)

( * ) Notice: Subject to any disclaimer, the term of this patent is extended or adjusted under 35 U.S.C. 154(b) by 808 days.

(21) Appl. No.: 12/601,754

(22) PCT Filed: Jun. 1, 2007

(86) PCT No.: PCT/SE2007/000530

§ 371 (c)(1),
(2), (4) Date: Nov. 24, 2009

(87) PCT Pub. No.: WO2008/147257

PCT Pub. Date: Dec. 4, 2008

(65) Prior Publication Data

US 2010/0170928 A1 Jul. 8, 2010

(51) Int. Cl.
*A45F 3/04* (2006.01)

(52) U.S. Cl.
USPC ..... 224/578; 224/259; 224/262

(58) Field of Classification Search
USPC ..... 224/259, 258, 260, 578, 579, 637, 638, 224/651
See application file for complete search history.

(56) References Cited

U.S. PATENT DOCUMENTS

| | | | | | |
|---|---|---|---|---|---|
| 2,553,275 | A | * | 5/1951 | Quilter | 244/151 A |
| 2,651,441 | A | * | 9/1953 | Rau et al. | 224/259 |
| 4,341,017 | A | * | 7/1982 | Janczak | 30/381 |
| 4,483,070 | A | * | 11/1984 | Junkermann | 30/296.1 |
| 4,776,504 | A | * | 10/1988 | Panth | 224/640 |
| 5,813,580 | A | * | 9/1998 | Fair | 224/160 |
| 5,913,464 | A | * | 6/1999 | Haberlein | 224/259 |
| 5,954,249 | A | * | 9/1999 | Panth | 224/234 |
| 6,247,624 | B1 | * | 6/2001 | Rundberg | 224/259 |
| 6,283,350 | B1 | * | 9/2001 | Gottmeier et al. | 224/639 |
| 6,543,101 | B2 | * | 4/2003 | Sack et al. | 24/633 |
| D503,276 | S | * | 3/2005 | Racov et al. | D3/228 |
| 7,040,518 | B2 | * | 5/2006 | von Krane et al. | 224/646 |
| 7,070,077 | B2 | * | 7/2006 | Egart et al. | 224/625 |
| 7,163,132 | B2 | * | 1/2007 | Rundberg | 224/637 |
| 7,712,196 | B2 | * | 5/2010 | Kawamura et al. | 24/630 |
| 7,770,765 | B2 | * | 8/2010 | Stevens et al. | 224/160 |
| D641,155 | S | * | 7/2011 | Tinius | D3/228 |
| D641,975 | S | * | 7/2011 | Tinius | D3/228 |
| 8,070,030 | B2 | * | 12/2011 | Marik | 224/624 |
| 8,418,898 | B2 | * | 4/2013 | Carlsson et al. | 224/162 |
| 2003/0121945 | A1 | * | 7/2003 | Lemanski, II | 224/579 |

FOREIGN PATENT DOCUMENTS

| | | | | |
|---|---|---|---|---|
| DE | 4038096 | A1 * | 7/1993 | A45F 3/04 |
| SE | 469544 | | 7/1993 | |

OTHER PUBLICATIONS

International Search Report; WO2008/147257. Feb. 22, 2008.

* cited by examiner

*Primary Examiner* — Justin Larson
*Assistant Examiner* — Lester L Vanterpool
(74) *Attorney, Agent, or Firm* — Novak Druce Connolly Bove + Quigg LLP

(57) ABSTRACT

A harness including a back portion, two shoulder straps (2) a support strap (6) for the tool, a side strap (4) for distributing the weight of the tool, and a chest plate (1). A fastening device (10) for the side strap (4) is detachable from the chest plate (1) and is attachable on the support strap (6) below the chest plate (1).

10 Claims, 7 Drawing Sheets

HARNESS AND CHEST PLATE THEREIN

TECHNICAL FIELD

The present invention relates to a harness for carrying a handheld motor-driven tool, such as a clearing saw, comprising a back portion, two shoulder straps a support strap for the tool, a side strap for distributing the weight of the tool, and a chest plate.

BACKGROUND ART

There are previously known harnesses for use with heavy equipment, such as clearing saws and brush cutters. The use of such harnesses is especially beneficial when the heavy equipment is used for extended periods of time, such as when they are used by professional users, but may also be useful to domestic users.

Known harnesses usually include shoulder straps, a side strap, a waist band, and a load carrying support strap, which are all connected, with at least one end to a back portion. Except for the waist band, the straps are connected with their respective second ends to a chest plate. The chest plate consists of two parts, which may be separated to provide quick and easy entrance into and exit from the harness, without having to adjust all the different straps.

Traditionally, the heavy and motorized equipment has been used by men and designed for men, which also applies to the harnesses used in conjunction with the equipment. The previously known harnesses are therefore highly appreciated by men, although there may be some complaints as to the weight distribution, which may be considered to be too concentrated to the shoulders, and not distributed, to a sufficient degree, to the waist band and the side band. The strain on the shoulders is especially noticeable during prolonged use of the harness and the heavy equipment.

Nowadays more and more women have gained their entrance into activities that have traditionally been dominated by men, both regarding professional occupations and in the private sphere, such as gardening. As an example should be considered that more than one third of the owners of forest estates in Sweden are women.

As a consequence more and more women use the heavy equipment, such as clearing saws, and the harnesses provided for use therewith. A recurrent complaint by women is that the chest plate of the harness and the side strap are positioned directly over their breasts, resulting in a pressure therefrom, which is uncomfortable, especially during prolonged use. Readjusting the straps in order to raise the chest plate to a higher position on existing harnesses results in that the side strap will be positioned too high up in the armpit, which is either uncomfortable or makes use of the harness impossible. Likewise, lowering the chest plate to a place below the breasts tends to result in that the side band will be positioned too low and will not fulfil its weight distributing object, and the shoulder straps will be too long so that the harness will be rendered unstable. Also, the shoulder straps will risk putting a pressure on the user's breasts, which is uncomfortable. Another disadvantage is that freedom of motion will be decreased if the chest plate is placed too close to the equipment and the shock absorbing hip pad, which it contacts, since the support strap will be too short.

Designing a harness especially for women has been considered, but, for reasons of logistics, has been considered less desirable. One single harness would be more desirable.

Thus, the main object of the present invention is to improve the existing harnesses so that one single harness is made adjustable for comfortable use by both men and women.

SUMMARY OF THE INVENTION

The object forming the basis of the present invention will be attained if the harness intimated by way of introduction is characterised in that the fastening device for the support strap is detachable from the chest plate and is attachable on the support strap below the chest plate.

Thus the harness according to the invention may be provided with a specially dedicated device arranged on the support strap for attaching the fastening device.

Further or alternatively the fastening device may be attachable directly on the support strap.

The chest plate in the harness according to the invention may also include a flat projection onto which the fastening device for the side strap is slidable.

Further the chest plate in the harness may be provided with a fastening device for the side strap that has a mainly flat, hook-like shape with a hair-pin-like profile.

Still further the chest plate may be taken apart into two separate parts for opening the harness.

BRIEF DESCRIPTION OF THE ACCOMPANYING DRAWINGS

The present invention will now be described in greater detail hereinbelow, with reference to the accompanying drawings. In the accompanying drawings.

DESCRIPTION OF EMBODIMENTS

Figure 1:
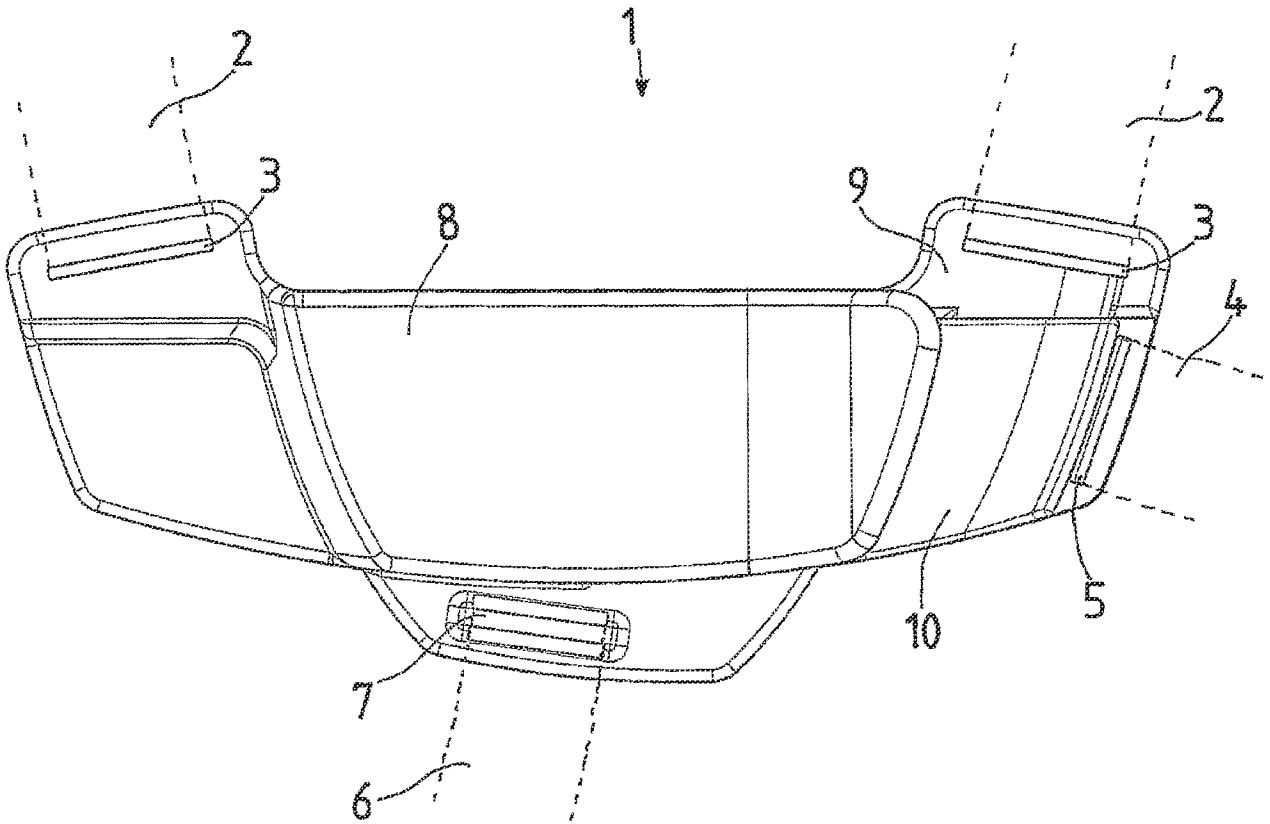
FIG. 1 is a plan view of the chest plate according to one embodiment of the invention in a closed position.

A chest plate 1 according to the invention is shown in FIG. 1. On either side of the upper edge portion, there are shoulder straps 2, attached adjustably in slits 3 therefor. On one side edge portion, there is a slit 5 for adjustable attachment of a side strap 4. At the bottom edge portion, there is a pair of slits 7 for adjustable attachment of a support strap 6, which bears a part of the weight of the equipment attached thereto. Extending to the side from the chest plate 1, there is provided the side strap 4, whereto the weight of the tool is distributed, at least partly. At the back of the harness, positioned on the user's back, there is a back portion (not shown), whereto the rear ends of the shoulder straps 2, the side strap 4, the support strap 6, and a waist belt 28 are fastened. The back portion preferably adopts the shape of a rigid back plate.

In the first embodiment, the chest plate 1 according to the invention comprises three parts 8, 9, 10, which are separable from each other. The main part 8 is the part to which the support strap 6 and one of the shoulder straps 2 are directly attached. The side part 9 is the part to which the other shoulder strap 2 is directly attached, and to which the side strap 4 is attached by way of the fastening device 10, which in turn is attached to the side part 9 in FIG. 1. The harness may be used with the chest plate 1 in the assembled condition as shown in FIG. 1 when worn by a user.

Figure 2:
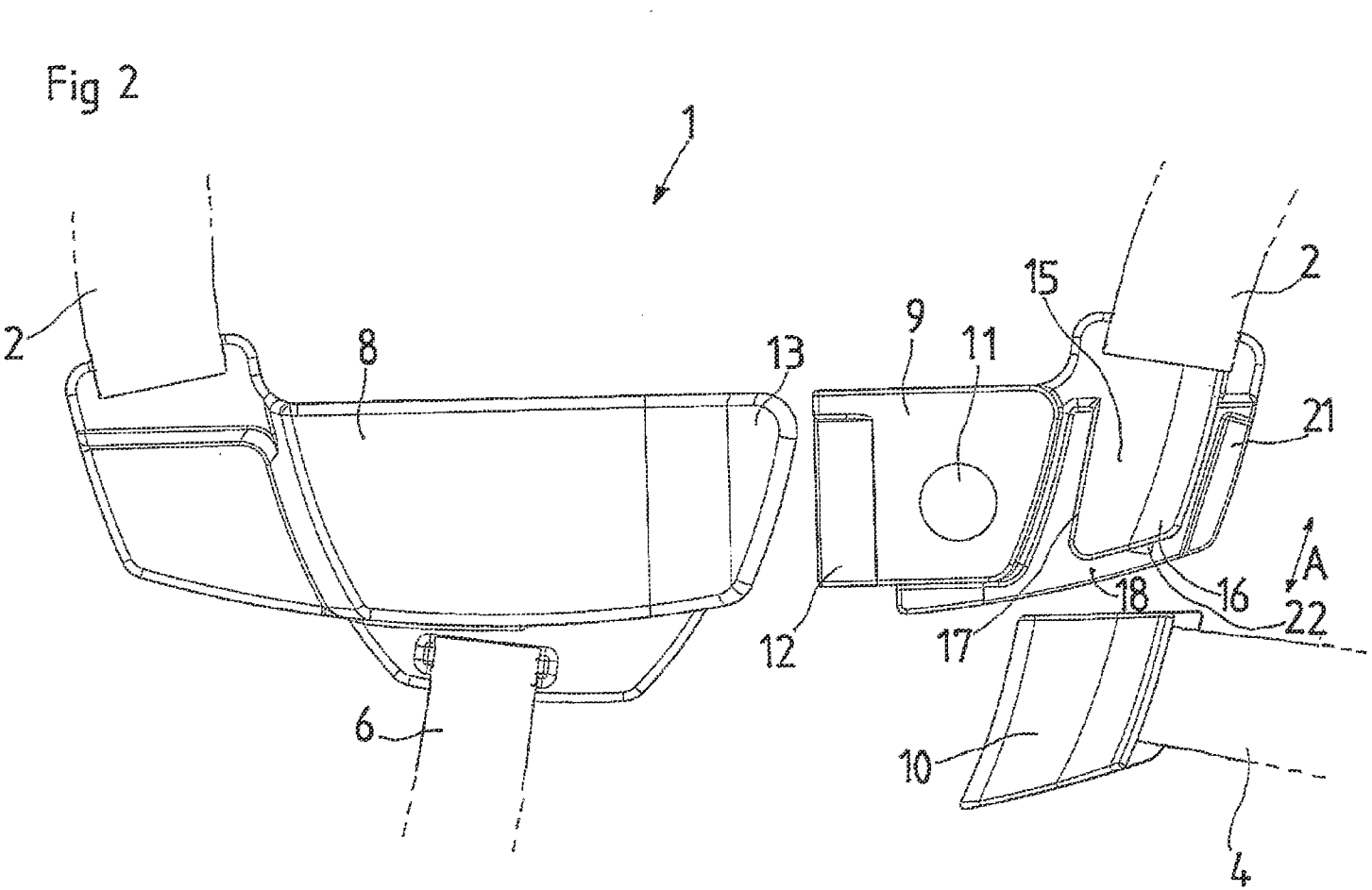
FIG. 2 is a view according to FIG. 1, wherein the chest plate is in an open position.

In FIG. 2 the chest plate 1 according to the first embodiment invention is disassembled so that all three parts 8, 9, 10 are separated. The main part 8 and the side part 9 are normally separated from each other in order to undo the fastening of the harness on the user thereof. All the adjustments of the straps 2, 4, 6 will be kept in place and the straps 2, 4, 6 need not be readjusted when the same user puts on the harness again. The side part 9 is provided with a hole 11, which is active in the snap fastening of the side part 9 in the main part 8. In order to achieve the snap fastening, there is also a slanting edge 12 on the side of the side part 9, facing the main part 8. Likewise, there is a bent portion 13 on the main part 8, facing the side part 9. A barely visible (FIG. 3), round projection 14 on the underside of the bent portion 13 is adapted to mate with the hole 11, when the side part 9 is slid sideways into the main part 8.

On the side part 9 there is also a mainly flat projection 15, which is visible in the disassembled condition of the chest plate 1. The outer edge 16 of the mainly flat projection 15 is somewhat thicker than its inner edge 17. The mainly flat projection 15 is provided at a distance from the integral bottom portion 18 of the side part 9. The purpose of the mainly flat projection is to make the fastening device 10 attachable on the side part 9 of the chest plate 1.

Figure 3:
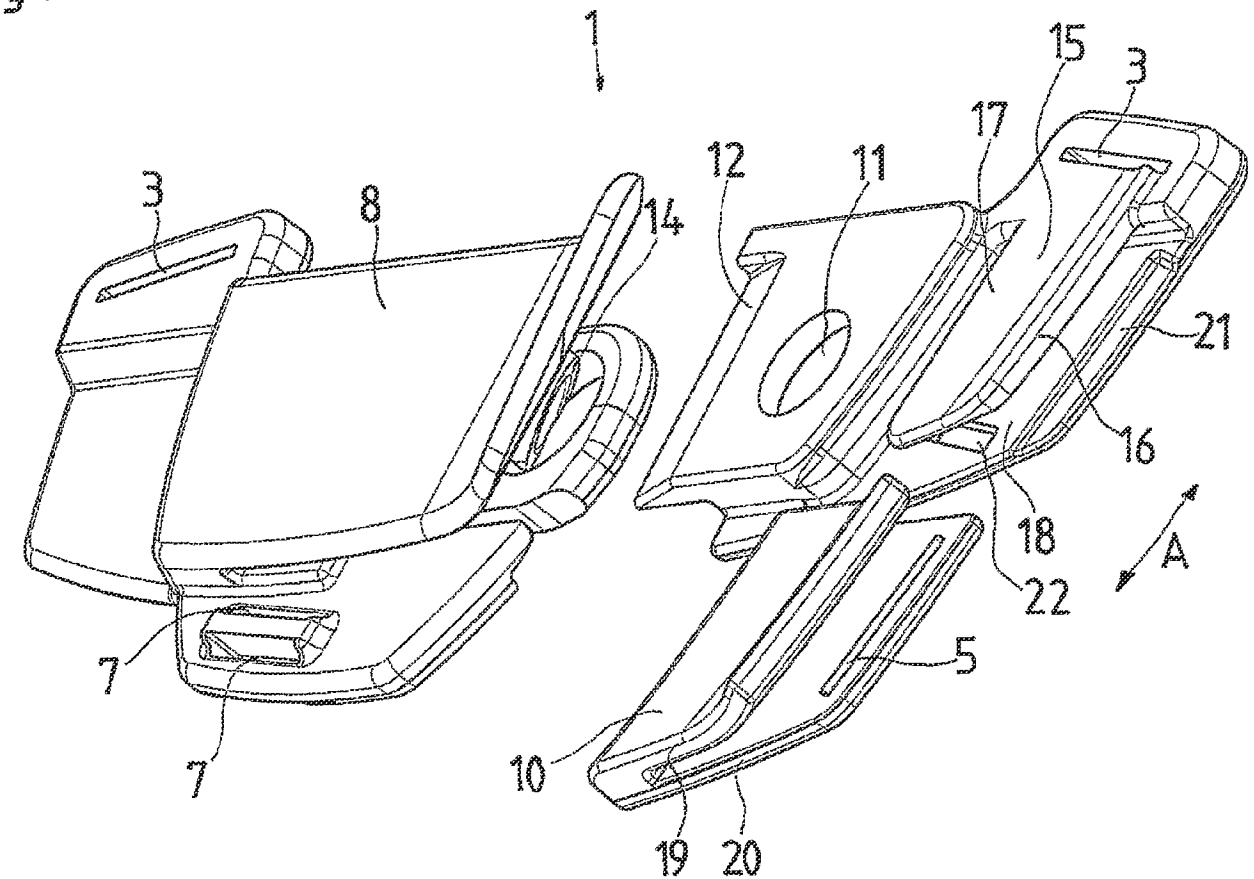
FIG. 3 is a perspective view of the chest plate according to FIG. 2.

The fastening device 10 has a flat, hook-like shape. It has two shanks 19, 20, as seen in FIG. 3, and the distance between them corresponds to the thickness and shape of the flat projection 15. Thus, as seen from the edge thereof, the fastening device 10 has a hair-pin-like profile. The fastening device 10 may be slid on to the mainly flat projection 15 in the direction of the arrow A, with a fit that is tight enough to keep the fastening device 10 from unintentional loosening therefrom. In the bottom portion 18, there is a first recess 21, to allow room for the side strap 4, which is attached to the fastening device 10. There is a second recess 22 in the bottom portion 18, corresponding to a not shown projection at the back of the fastening device 10. When the fastening device 10 is to be loosened from the side plate 9, the shanks 19, 20 are pressed slightly together to lower the friction and snap fit between the fastening device 10 and the bottom portion 18, so that the fastening device 10 will be released.

Figure 4:
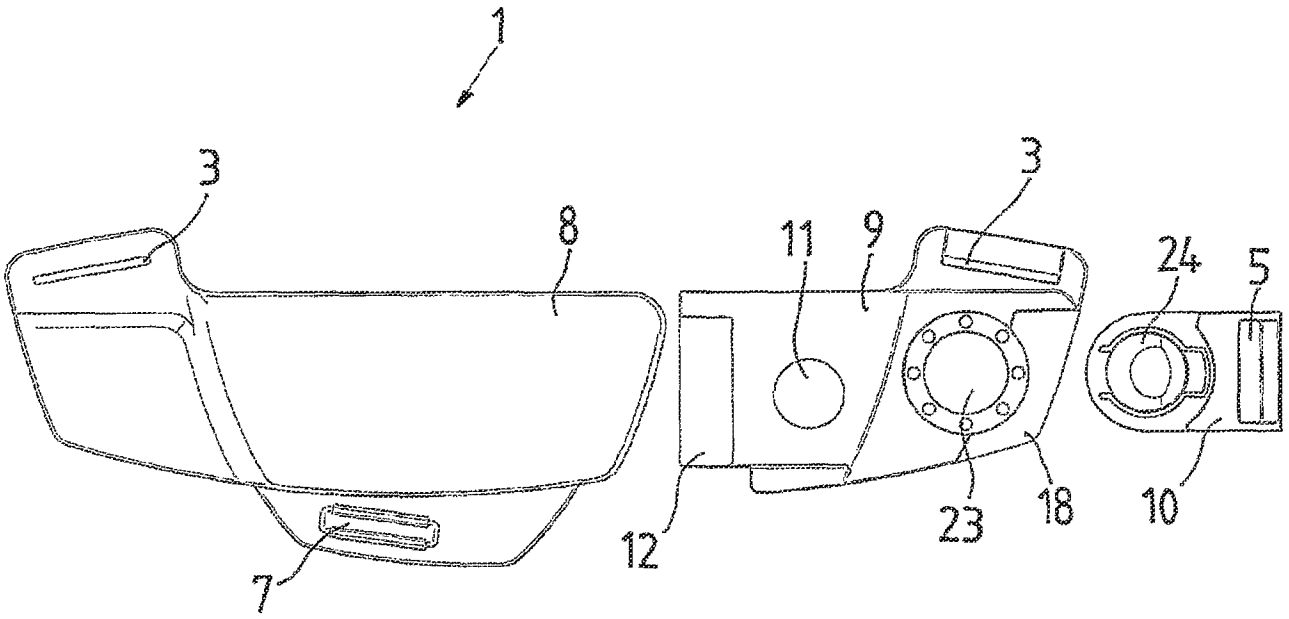
FIG. 4 is a view according to FIG. 2 of another embodiment of the invention.

The invention may be varied in that the means for attaching the fastening device 10 on the side part 9 and the strap 6, respectively, may be changed. To this end a separate holder or attachment device 25, mating with the fastening device 10, may be slidably attached on the support strap 6. The separate holder 25 may or may not have features that are identical with the corresponding means for attaching the fastening device 10 on the side part 9. Another embodiment of the invention, displaying different features in there respects, is shown in FIGS. 4 and 5.

Instead of the flat projection 15, the side part 9 is provided with a hole 23, with which a projection 24, with an outer shape matching the shape of the hole 23, corresponds. The projection 24, which is approximately circular, may be snapped into the hole 23, in order to secure the fastening device on the side plate, which in turn may be fastened on the chest plate 1.

Figure 5:
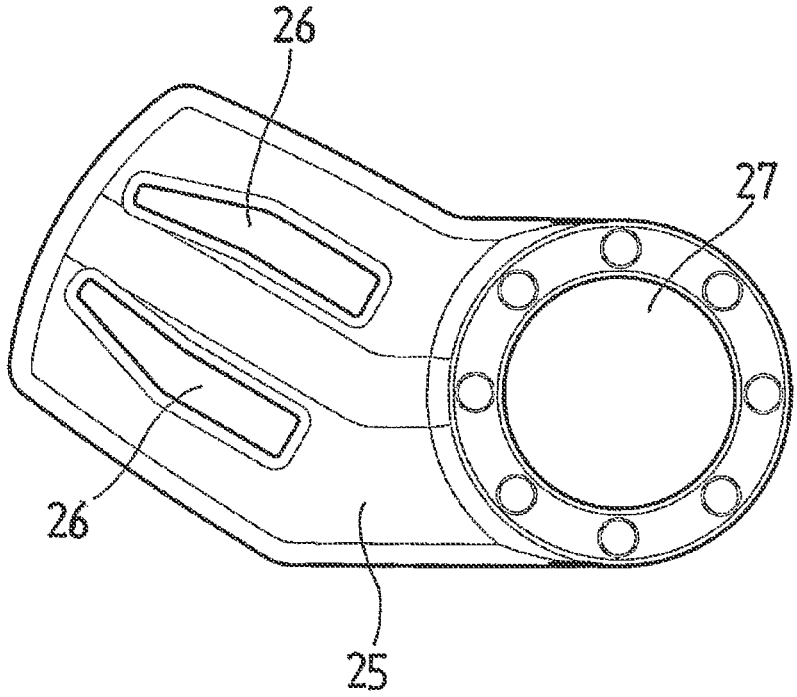
FIG. 5 is a plan view of an attachment clasp comprised in the embodiment according to FIG. 4.

In FIG. 5 the holder or attachment device 25 is shown. It has two cuneiform slits 26, through which the support strap 6 passes. The holder 25 is also provided with a hole 27, similar to the hole 23 in the side plate 9 and corresponding to the projection 24, for snap-fastening attachment of the fastening device 10 to the holder 25.

Figure 6:
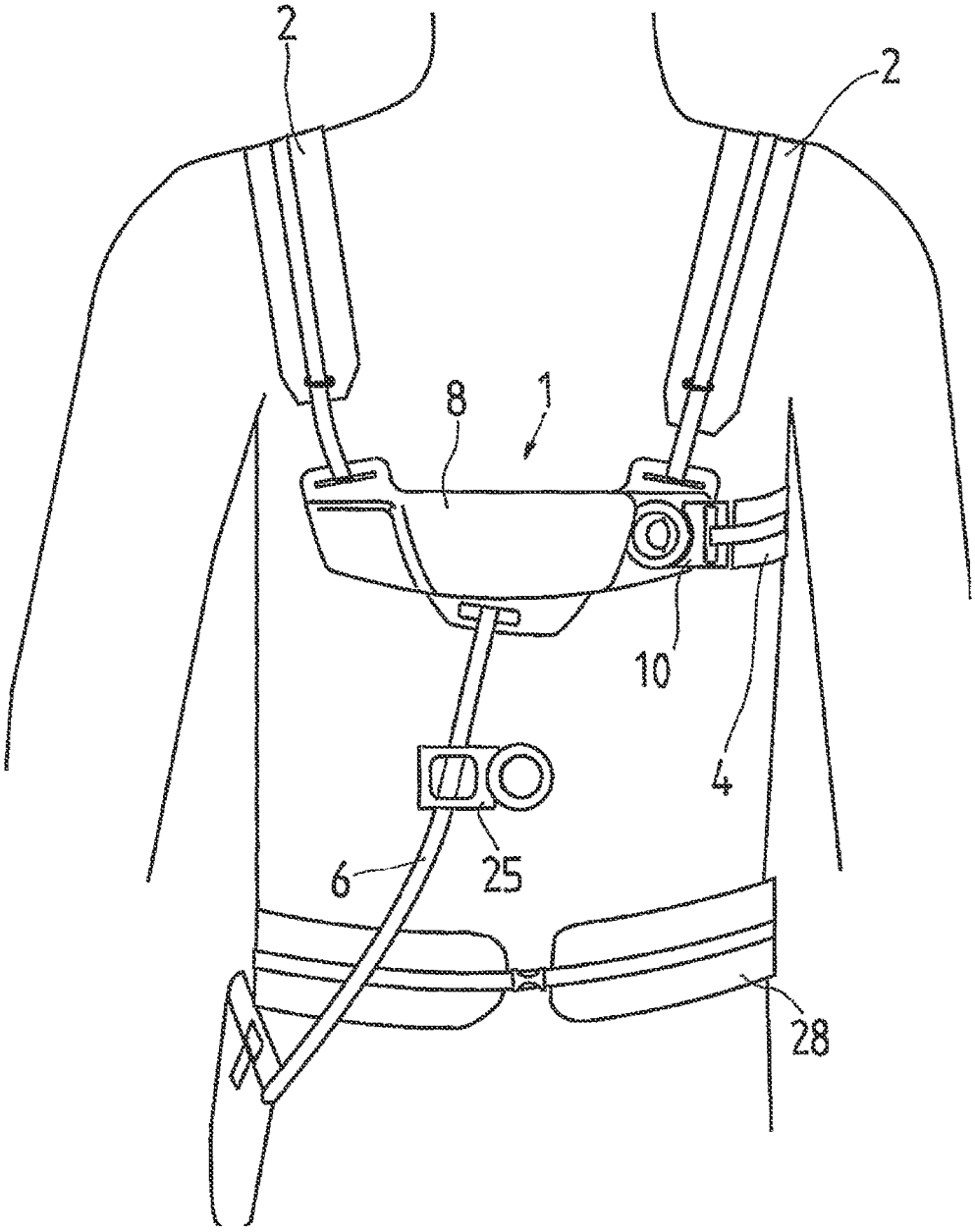
FIG. 6 is a view of the harness according to the embodiment in FIG. 4, worn by a man, with the chest plate in a lower position.

FIG. 6 shows the harness used by a male user, and the fastening device 10 is attached to the chest plate 1 in the position that has been described above and shown in FIG. 1. However, it should be noted that the details of the attachment of the fastening device 10 to the chest plate 1 correspond mainly to the latter embodiment described above, but the general features of the harness are the same for all embodiments.

With the hook-like shape of the fastening device 10 of the first embodiment, it is also ideal for fastening directly onto an extended, flat object, such as the support strap 6, which is transversal of the fastening device 10 and its attached side strap 4. By doing so, the position of the side strap 4 may be kept at a comfortable position under the arm and close to the user's body. The side strap 4 will keep its abilities of taking up lateral forces, which result from the weight of the equipment hanging on the other side of the user's body. The fastening device may, however, also be attached to the separate holder 25 on the support strap 6.

Figure 7:
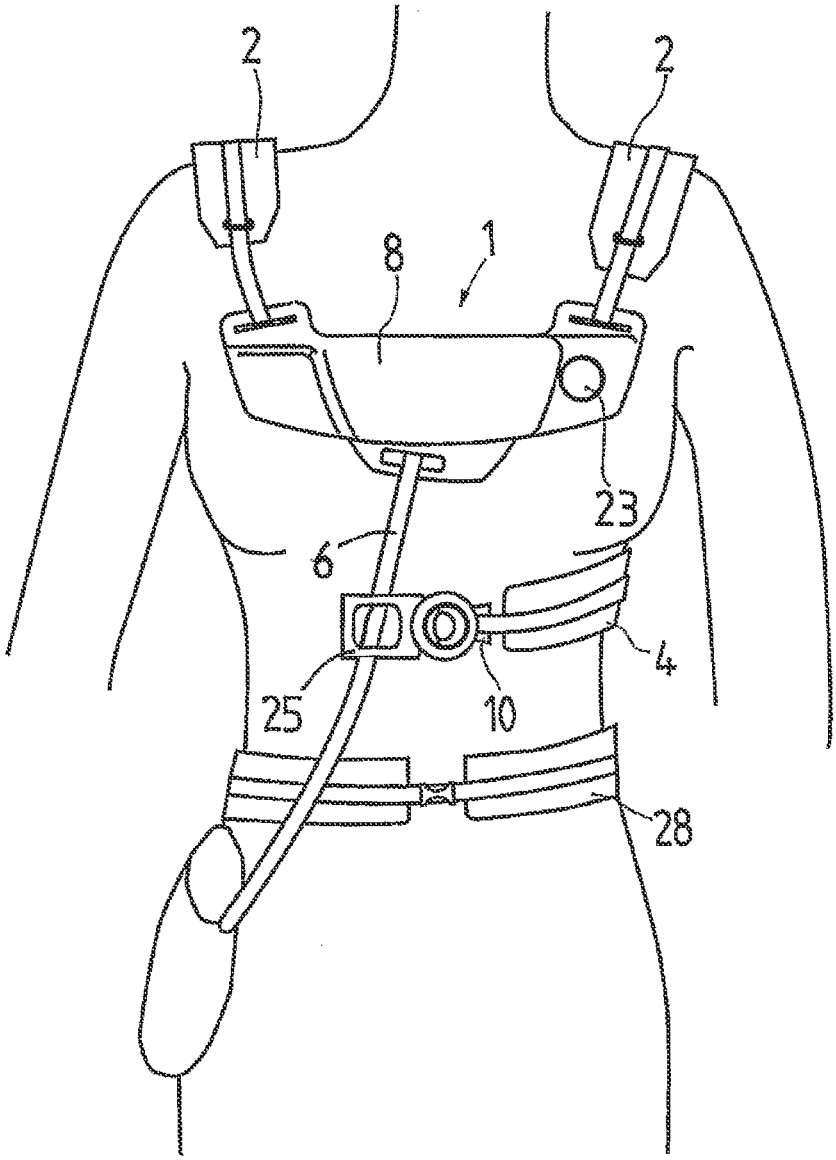
FIG. 7 is a view according to FIG. 6 of the harness worn by a woman, with the chest plate in a higher position.

The harness 1 in this position is shown in FIG. 7, where it is worn by a female user. In this figure it is clear that the support strap 6 extends downwards from the chest plate 1 between the breasts of the user, and the chest plate 1 itself may be raised to a higher position, and the shoulder straps 2 shortened. As was stated above, the details of the attachment of the fastening device 10 to the chest plate 1 are not identical to the first embodiment, but the general features and principles of moving the side strap 4 are the same.

In order to make it clear to the user that the fastening device 10 could take on a different position than the position shown in FIGS. 1 and 6, the fastening device 10 has preferably a colour that is the same as the support strap 6 or the holder 25, but different from the rest of the chest plate 1.

When the fastening device 10 is attached to the support strap 6, the chest plate 1, now comprising only the main part 8 and the side part 9, may be moved upwards on the user's body by shortening the shoulder straps 2 and extending the support strap 6, as shown in FIG. 7. The side strap 4 will be able to stay in its intended position as the fastening device 10 may adopt any desired position on the support strap 6. Hence the previously experienced, uncomfortable pressure on the breasts of women using the harness will be avoided. Another advantage is that the weight distribution in the harness will be improved. The user will experience an improved possibility to adjust the weight distribution, so that more forces will be taken up by the waist band 28 and the side strap 4. More force will be taken up by the side of the user's body instead of by the user's shoulders, when the side strap 4 adopts a low position. This provides the possibility of a variation in the strain on the user's body.

Since the support strap 6 is always pulled downwards by the weight of the equipment and the reach of the fastening device 10 is limited by the length of the side strap 4, there will always be a sufficient contact force between the fastening device 10 and the support strap 6 to keep the fastening device 10 from unintentionally sliding along the support strap 6 or accidentally come undone, even if an especially dedicated holder or attachment device 25 is not provided on the support strap 6.

Alternative Embodiments

The embodiments of the invention, described above, are exemplary only, and may be varied by replacing the previously known features, such as the attachment of the straps 2, 4, 6, by other, equivalent features. This is also valid for the snap fastening 11, 14 of the main part 8 and the side part 9.

The invention claimed is:

1. A harness for carrying a handheld motor-driven tool, such as a clearing saw, comprising a back portion, two shoulder straps a support strap, a side strap for distributing the weight of the tool, and a chest plate, wherein a fastening device for the side strap is detachable from the chest plate and is attachable on the support strap below the chest plate, wherein a specially dedicated device is arranged on the support strap for attaching the fastening device.

2. The harness according to claim 1, wherein the chest plate can be taken apart into two separate parts for opening the harness.

3. The harness according to claim 1, wherein the chest plate includes a hole into which the fastening device is snappable.

4. The harness according to claim 3, wherein the fastening device has a projection with a shape corresponding to the hole to be attachable therein.

5. The harness according to claim 1, wherein the chest plate includes a flat projection onto which the fastening device is slidable.

6. The harness according to claim 5, wherein the fastening device has a mainly flat, hook-like shape with a hair pin-like profile to be attachable on the flat projection.

7. The harness according to claim 1, wherein the back portion is a rigid back plate with fastening means for the rear ends of attachment straps in the harness, such as the shoulder straps, the side strap, the support strap, and a waist belt.

8. A harness for carrying a handheld motor-driven tool, such as a clearing saw, comprising a back portion, two shoulder straps a support strap, a side strap, and a chest plate, wherein a fastening device for the side strap is detachable from the chest plate and is fixably attachable on the support strap, below the chest plate, by a quick release attachment device.

9. The harness according to claim 8, wherein the side strap is arranged to prevent movement of the side strap relative to the support strap in an attached configuration.

10. A harness for carrying a handheld motor-driven tool, such as a clearing saw, comprising a back portion, two shoulder straps a support strap, a side strap, and a chest plate, wherein a fastening device for the side strap is detachable from the chest plate and is attachable on the support strap below the chest plate, so that the fastening device does not unintentionally slide along the support strap.

* * * * *